United States Patent [19]

Goddard et al.

[11] 4,139,404

[45] * Feb. 13, 1979

[54] ACTIVE BINDER PROPELLANTS INCORPORATING BURNING RATE CATALYSTS

[75] Inventors: Terrence P. Goddard, Aptos; Donald N. Thatcher, Hollister, both of Calif.

[73] Assignee: Teledyne McCormick Selph, Hollister, Calif.

[ * ] Notice: The portion of the term of this patent subsequent to Jan. 23, 1996, has been disclaimed.

[21] Appl. No.: 696,324

[22] Filed: Jun. 15, 1976

Related U.S. Application Data

[63] Continuation-in-part of Ser. No. 592,449, Jul. 2, 1975, abandoned, which is a continuation-in-part of Ser. No. 585,216, Jun. 6, 1975, abandoned.

[51] Int. Cl.[2] ..... C06B 45/10

[52] U.S. Cl. ..... 149/19.2; 149/19.8; 149/22; 149/96

[58] Field of Search ..... 149/22, 19.2, 19.8, 149/96

[56] References Cited

U.S. PATENT DOCUMENTS

| | | | |
|---|---|---|---|
| 3,107,613 | 10/1963 | Armstrong et al. | 149/61 X |
| 3,126,305 | 3/1964 | Armstrong | 149/61 X |
| 3,148,938 | 9/1964 | Knoth | 149/22 X |
| 3,149,163 | 9/1964 | Knoth | 149/22 X |
| 3,256,056 | 6/1966 | Armstrong | 149/22 X |
| 3,689,331 | 9/1972 | Pierce | 149/22 X |
| 3,808,061 | 4/1974 | Pierce | 149/22 X |
| 4,002,681 | 1/1977 | Goddard | 250/564 D |

*Primary Examiner*—Edward A. Miller

*Attorney, Agent, or Firm*—David H. Semmes; Warren E. Olsen

[57] ABSTRACT

New propellant compositions characterized by the addition of certain simple salts and double salts, both metallic and non-metallic, having the $B_{10}H_{10}^{-2}$ anion in common, are taught herein to function as a class of burn rate catalysts, and not as fuels, when combined with a category of propellants known as nitrocellulose base propellants. Additionally, unique forms of the simple salts, created by coprecipitation of the simple salt with an oxidizer, constitute a third class of burn rate enhancers herein.

17 Claims, No Drawings

ACTIVE BINDER PROPELLANTS INCORPORATING BURNING RATE CATALYSTS

CROSS REFERENCE TO RELATED APPLICATIONS

This application is a continuation-in-part of copending application METHOD FOR PREPARING A HIVELITE HIGH BURN PROPELLANT COMPOSITION, Ser. No. 592,449, filed July 2, 1975, now abandoned, which in turn is a continuation-in-part of Ser. No. 585,216, filed June 6, 1975 and entitled HIGH BURN PROPELLANT COMPOSITIONS, now abandoned.

BACKGROUND AND SUMMARY OF THE INVENTION

The purpose of this invention is to describe propellants with a controllable burning rate and a process for preparing them. The propellants comprise a class of nitrocellulose base materials that incorporate a burning rate enhancer chosen from any of three classes of compounds based on decahydrodecaborate salts.

The present invention describes a class of propellants that are useful as gun or rocket propellants and in pyrotechnic devices such as gas generators. In these types of applications, a controlled amount of gas and heat must be released within a specified time period by the burning propellant. With existing propellants based on nitrocellulose, nitrocellulose/nitroglycerine, and nitrocellulose/nitroglycerine/nitroguanidine, and better known to those practiced in the art as "single base," "double base," and "triple base" propellants, respectively, the burning rate of the propellant is fixed within rather narrow limits by the formulation; a major change in propellant formulation is required to significantly alter such characteristics as burning rate. As a result, to control the release of heat and gas in a device such as a rocket motor chamber, gun chamber, or other gas generating device, the propellant is configured into a sometimes complicated three dimensional geometry, known as a "grain," so that the amount of surface burning at a given time is controlled, rather than the actual regressive burning rate of the propellant matrix. In addition, the manufacturing lot-to-lot variations in characteristics such as burning rate are somewhat difficult to control for certain classes of these propellants.

This invention describes propellants in which the burning rate is easily controlled, by the addition of a burning rate catalyst into the propellant matrix. An important feature of the invention is that the burning rate catalyst can be added to numerous existing propellant formulations to derive the subject propellants, with the effect that the range of burning rates available from the manifold of tested and qualified propellants can be greatly enhanced. The method of adding the burning rate catalyst is not critical: it can be added during the manufacturing process, or alternatively, after the nitrocellulose base propellant has been completely processed, or even formed into a grain. The new propellants incorporating the burning rate catalyst into the entire bulk of the propellant to alter the burning characteristics throughout the grain, or by "seeding" the catalyst into a surface layer of an existing grain, so that the grain is effectively coated with a surface layer of the new propellant composition, thereby altering the initial burning rate of the grain.

The end product of the subject invention is a nitrocellulose base propellant that enables the grain designer a much broader range of burning rate options, which can in turn be used simply with existing grains or perform more sophisticated functions with new designs.

DETAILED DESCRIPTION OF THE INVENTION

The compositions of this invention consist of propellants incorporating nitrocellulose as the primary binder, and other ingredients including plasticizers, such as nitroglycerin, monopropellants such as nitroguanidine, stabilizers such as triacetin, and other additives to alter physical or thermochemical characteristics, and most important, a burning rate catalyst chosen from one of three classes of compounds based on decahydrodecaborate salts. The compositions, less the decahydrodecaborate salts, may be any composition known to those practiced in the art, as "single base," "double base," or "triple base" propellants, which have as a common ingredient nitrocellulose as the primary binder.

The general propellant formula may be described as follows:

| COMPONENT | PROBABLE RANGE, WEIGHT % |
|---|---|
| 1. Binder (Nitrocellulose) | 8–99.9 |
| 2. Decahydrodecaborate compound | 0.01–20 |
| 3. Oxidizer or monopropellant | 0–60 |
| 4. Other additives, such as energetic plasticizers, coloring agents | 0–40 |

The three classes of decahydrodecaborate compounds are further defined as follows:

Class 1

The simple decahydrodecaborate salts used according to the first class of burn rate enhancers within the present invention are compounds of the general chemical formula:

$$M_x(B_{10}H_{10})_y$$

where M is a cation or complex cation incorporating hydrogen, nitrogen, carbon, or metals, or some combination thereof, and is chosen from the list given below; x is the number of M ions; and y is equal to:

x times the valence of the M ion/2

The compounds may further be defined as salts of decahydrodecaboric acid, and thus contain as a common ion the decahydrodecaborate (−2) anion $B_{10}H_{10}^{-2}$.

The cation M is chosen from the classes:

(a) ammonium, $NH_4+$, wherein the salt has the formula $(NH_4)_2B_{10}H_{10}$, and is described by KNOTH U.S. Pat. No. 3,148,938.

(b) hydrazinium, $NH_2NH_3+$, wherein the salt has the formula $(NH_2NH_3)_2B_{10}H_{10}$, and is described by KNOTH U.S. Pat. No. 3,148,938, (c) substituted ammonium cations, wherein the salt has the general formula $(R_3NH)_2B_{10}H_{10}$, where R can be hydrogen (H) or an alkyl radical (preferred radicals contain less than six (6) carbon atoms). The R's in the preceeding formula may represent different alkyl groups. Compounds with two or three hydrogen radicals are described by KNOTH U.S. Pat. No. 3,149,163.

Typical cations are methylammonium $(CH_3)NH_3^+$, dimethylammonium $(CH_3)_2NH_2^+$, trimethylammonium $(CH_3)_3NH^+$, and triethylammonium $(CH_3CH_2)_3NH^+$.

(d) substituted hydrazinium cations, wherein the salt has the general formula $(R_2NNR_2H)_2B_{10}H_{10}$, where R can be hydrogen (H) or an alkyl radical (preferred radicals contain less than six (6) carbon atoms), and the substituted alkyl groups can be symmetric or assymmetric with respect to the N—N linkage. Symmetric substituted cations are described by KNOTH U.S. Pat. No. 3,149,163. An example of an unsymmetric substituted cation is (1,1) dimethylhydrazinium. The R's in the preceding formula may be mixed alkyl radicals.

(e) quaternary ammonium salts of the general formula $(R_4N)_2B_{10}H_{10}$, where R is an alkyl radical; the R's in the preceding formula may represent mixed alkyl groups. Examples of typical cations are tetramethylammonium $(CH_3)_4N^+$ and tetraethylammonium $(CH_3CH_2)_4N^+$.

(f) aryl containing cations, such as pyrididinium, bipyridinium, or substituted aryl cations, such as aryldiazonium cations.

(g) guanidinium ion, $C(NH_2)_3^+$, wherein the salt has the formula $(C(NH_2)_3)_2B_{10}H_{10}$, and is described in the copending application of common assignment, entitled BIS-GUANIDINIUM DECAHYDRODECABORATE AND A PROCESS FOR ITS PREPARATION, filed Jan. 10, 1976, and now U.S. Pat. No. 4,002,681.

(h) metal ions, derived from metals defined by a Periodic Table such as that in the "Handbook of Chemistry and Physics," 54th Edition, inside front cover, by the elements in Groups 1, 2, 8, 3b, 4b, 5b, 6b and 7b, and the elements of Groups 3a, 4a, 5a, and 6a with atomic numbers greater than 5, 14, 33, and 52 respectively. The metal decahydrodecaborate salts are further described by KNOTH U.S. Pat. No. 3,148,939. Examples of such metal salts are $Cs_2B_{10}H_{10}$ and $K_2B_{10}H_{10}$, the cesium and potassium salts of decahydrodecaboric acid, which are representative of alkaline metal decahydrodecaborate salts, having atomic numbers less than 87, preferred for the compositions described in this invention.

The salts of the decahydrodecaborate (−2) ion (Chemical formula $B_{10}H_{10}^{-2}$) are conveniently prepared by stoichiometrically reacting an aqueous solution of the parent acid, dihydrogen decahydrodecaborate, $H_2B_{10}H_{10}$, with (1) a soluble hydroxide of the desired cation, such as ammonium hydroxide, (2) the conjugate Brønsted base of the desired cation, such as a free amine, or (3) a soluble salt of the desired cation, such that the salt anion is destroyed during the reaction, such as guanidine carbonate. A Brønsted base is any substance capable of accepting a proton in a reaction; the definition is elaborated upon in any elementary chemistry text, such as Dickerson, Gray and Haight, "Chemical Principles, 2nd Edition," 1974, page 135.

The aqueous solutions of the salts, prepared above, may be evaporated to dryness to recover the crystalline salt. Alternatively, some salts may be precipitated from the aqueous solution by a nonsolvent that is miscible with water. The salts may be purified by recrystallization.

The aqueous decahydrodecaboric acid used as a starting material for the process of this invention is conveniently prepared by passing an amine or metal salt of the decahydrodecaborate (−2) ion through a column containing a strongly acidic ion exchange resin of the sulfonic acid type, such as a DUOLITE type "C-20," acid form by the Diamond Shamrock Corporation. Preferred starting salts are bis(triethylammonium) decahydrodecaborate (−2) and disodium decahydrodecaborate (−2). The preparation and properties of the aqueous acid, and additional preparative methods for metallic salts, are described in more detail in U.S. Pat. No. 3,148,939.

The simple non-metallic decahydrodecaborate salts themselves are capable of further utility within pyrotechnic compositions, as disclosed in another copending application entitled IGNITION AND PYROTECHNIC COMPOSITIONS, filed June 10, 1976, and assigned Ser. No. 694,625, also as a continuation-in-part of the above-noted parent applications.

Class (2)

Double salts of the formula $M_x(B_{10}H_{10})_y.N_zP_t$, where M, x, and y are as described in (1), N is a cation or complex cation incorporating hydrogen, metals, or nonmetals, or some combination thereof, z is the number of N ions, P is an oxidizing anion, composed of oxygen and a nonmetal, in some combination thereof, and t is equal to:

$$\frac{z \text{ times the valence of the } N \text{ ion}}{\text{valence of the } P \text{ ion}}$$

The ratio (x/z) is a ratio of small whole numbers.

The compounds may further be defined as double salts that include a cation, $M_x$, as defined above, the decahydrodecaborate (−2) ion ($B_{10}H_{10}^{-2}$), together with an additional oxidizing anion such as nitrate or dichromate. Preferred salts in this category include the double salt of cesium decahydrodecaborate and cesium nitrate, chemical formula $(Cs_2B_{10}H_{10})CsNO_3$, and the double salt of cesium decahydrodecaborate and cesium dichromate, chemical formula $(Cs_2B_{10}H_{10})_2Cs_2Cr_2O_7$, which salts themselves are further described in U.S. Pat. No. 3,107,613, and U.S. Pat. No. 3,265,056, respectively.

Class 3

An intimate blend of the compounds described in Class (1) above, with an oxidizing agent, in a manner that a chemically and physically different product is obtained than the starting materials.

The process by which the compositions of this class are prepared produces a very intimate blend of decahydrodecaborate (−2) ion with the oxidizer and makes the compositions so prepared chemically and physically unique from physical blends of decahydrodecaborate (−2) salts with oxidizer or pyrotechnic compositions incorporating decahydrodecaborate (−2) salts produced by other means. In general, the process consists of dissolving, in a suitable solvent, a decahydrodecaborate (−2) salt, as described above. The subject composition is recovered by precipitating the composite ingredients of the solution with a suitable nonsolvent. The resulting solid, after filtration and drying, comprises an intimate mixture of the decahydrodecaborate (−2) anion with the oxidizing cation or substance, in a form that is chemically and physically different than the starting materials.

The process may be properly called a "cocrystallization" or "coprecipitation" and the resulting produce a "cocrystallate" or "coprecipitate."

An essential component of Class (3) compounds is an oxidizing agent; i.e., a material that will readily react or burn when mixed with the decahydrodecaborate (−2) salt. Any solid oxidizing agent which will yield oxygen upon decomposition will fulfill this role; solid oxygen containing metal or nonmetal salts are preferred because of their availability, stability, and ease of incorporation into the composition.

Solid oxidizing agents useful in this invention must meet certain criteria, as listed in the description of the coprecipitation process. In general, solid oxidizing agents include ammonium, substituted ammonium, guanidine, substituted guanidine, alkali and alkaline-earth salts of oxygen containing acids such as nitric, perchloric, permanganic, manganic, chromic, and dichromic acids. Preferred species for this invention, which gave good thermal stability and low hygroscopicity include ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate. Other solid oxidizing agents which would be used if the appropriate solvent/nonsolvent system were used include ammonium, substituted ammonium, guanidine, substituted guanidine, alkali and alkaline-earth salts of other oxygen-containing acids such as chloric, persulfuric, thiosulfuric, periodic, iodic and bromic acids. Other stable oxides include lead thiocyanate, the oxides and peroxides of the light and heavy metals and nonmetals, such as barium peroxide, lead peroxide ($PbO_2$), lithium peroxide, ferric oxide, red lead ($Pb_3O_4$), cupric oxide, tellurium dioxide, antimonic oxide, etc., and nonionic substances such as nitrocellulose, nitroguanidine, and cyclotetramethylenetetranitramine (HMX). Mixtures of the aforementioned oxidizing agents also can be used.

These unique coprecipitated Class 3 salts, containing the $B_{10}H_{10}^{-2}$ anion, and the process for their creation, are themselves further disclosed in our copending application entitled COPRECIPITATED PYROTECHNIC COMPOSITION PROCESSES AND RESULTANT PRODUCTS, filed June 10, 1976, assigned Ser. No. 694,626, which is incorporated herein by reference.

The compositions of this invention make use of the unique decomposition properties of the decahydrodecaborate (−2) anion, a bicapped square antiprism polyhedral ion with unusual stability; the ion is believed to be kinetically rather than thermodynamically stabilized. The ion demonstrates an unusually fast decomposition upon oxidation, which is believed to proceed through the labile apical hydrogen atoms bonded to the cage. When incorporated into a nitrocellulose base propellant, the decahydrodecaborate (−2) ion acts in such a manner as to control the overall burning rate of the propellant, so that the overall composition exhibits an accelerated, and in some cases a stabilized burning rate.

In the subject propellant compositions, a decahydrodecaborate (−2) compound, from the forementioned three classes, is used in a catalytic amount, i.e., from 0.01% to an upper limit of 20%. The effect of the incorporation of the decahydrodecaborate ion into the propellant matrix is profound; the intrinsic burning rate of a typical double base propellant can be doubled with as little as 5% by weight of the decahydrodecaborate catalyst.

The method of incorporating the decahydrodecaborate (−2) compound into the propellant is not critical, and may be accomplished by a variety of means. The advantage of this invention is that previously formulated nitrocellulose base propellants can be used as one ingredient in the subject propellants. The decahydrodecaborate (−2) compound may be incorporated with the preformulated propellants during the manufacturing phase, by adding the decahydrodecaborate (−2) compound along with other ingredients to a nitrocellulose in a solvent slurry form, or alternatively by starting with a previously manufactured propellant and adding the decahydrodecaborate by softening the propellant matrix and mixing the decahydrodecaborate compound with the softened material.

The decahydrodecaborate (−2) compounds are amenable to incorporation into the subject propellants either dissolved in a suitable solvent, such as acetone or acetone/alcohol mixtures, which is also a solvent for the nitrocellulose based propellant, or alternatively, carried as an undissolved suspension in a liquid such a butyl acetate, which is a solvent or softening agent for the preformulated propellant.

Examples of acetone or acetone/ethanol soluble decahydrodecaborates are bis-ammonium decahydrodecaborate (−2) and potassium decahydrodecaborate (−2), representatives of Class (1)a and Class (1)h, respectively. Examples of decahydrodecaborates insoluble in acetone or butyl acetate are cesium decahydrodecaborate (−2), bis-tetramethylammonium decahydrodecaborate (−2), and cesium nitrate, and the coprecipitate of cesium decahydrodecaborate (−2) with potassium nitrate, which are representatives from Classes (1)h, (1)e, (2), and (3), respectively.

A convenient method of preparation of the subject propellants is to obtain the precured or preformulated propellant as a slurry or softened using a method commonly practiced for the particular material, for example with heat, by solvent swelling, or solvent dissolving. The solid or dissolved ingredients are blended with the softened or slurried binder in a suitable mixing apparatus, usually under vacuum, until the mixture is of adequate uniformity. The order of addition of ingredients and details of the blending cycle may vary with the specific formulation. After blending, the soft propellant is formed into the final configuration, commonly by casting or extruding, and allowed to harden, for example by loss of solvent or loss of heat.

EXAMPLE I

A quantity of a typical propellant consisting of 48% by weight nitroglycerine, 12.05% triacetin, 5% cellulose acetate, 2% nitrodiphenylamine, 2% lead 2-ethyl hexoate, and 0.05% candilla wax, simply and well-known in this art by the identifier "X-9 double base propellant," is obtained in a sheet form of approximate thickness ⅛ inch. This X-9 double base propellant is a typical double base propellant, and results obtained with this material are representative of the magnitude of effectiveness of the compositions that are the subject of this invention.

100g of X9 propellant is softened with approximately 250 ml butyl acetate over a period of 24 to 72 hours. The softened material is charged into a Baker-Perkins sigma blade mixer at 100° F. and degased for 30 minutes at a vacuum of 28" Hg minimum. Two (2) grams of bis-ammonium decahydrodecaborate (−2) is added to the mixer, and blending at 100° F. under vacuum is continued for an additional 30 minutes. The resulting blend, after the mixing cycle, is a uniform mass with a very thick consistency.

Propellant burn rate strands are made by extruding the blend propellant to the desired dimensions, using an extruder barrel and ram mounted in an air operated press, in a well-known manner.

The strands are dried at ambient temperature and pressure, for a minimum of three days, and thereafter under a vacuum of 28" Hg minimum for a minimum of two days. During the drying period, the outside cross sectional dimensions may shrink to ⅛ inch, from a ¼ inch initial dimension, due to the evaporation of butyl acetate.

The dried strands inhibited with three or four layers of ethyl cellulose by dipping in a solution of ethyl cellulose dissolved in 60% ethyl lactate and 40% butyl acetate. After coating is complete, the inhibited strands are dried for 72 hours minimum at 110° F.

A similar batch of X9 propellant is processed in an identical manner as described above, except that no bis-ammonium decahydrodecaborate (−2) is added, to serve as a control or "standard" to determine the effects of adding the decahydrodecaborate salts.

The inhibited burn rate strands are cut to a length of approximately 3½ inches. A nichrome ignition wire is inserted through a 1/16 inch hole drilled ½ inch from one end of the strand. Three lacquer-coated solder breakwires are inserted through 1/16 inch holes spaced at 1 inch intervals from the ignition wire; the breakwires are potted into place with Duco cement. The strand with attached wires is securely fastened with phenolic tiedowns to a phenolic plate, and electrical connections to the wires made. The phenolic plate is mounted in a pressure bomb; electrical connections are made through a feedthrough mounted in the bomb flange. The sealed bomb is pressurized to 1000 psi. A 28V pulse applied to the ignition wire ignites the strand. Time between successive breakwire breaks is recorded, as well as pressure rise in the bomb as a function of time. The reciprocal of the time between successive wire breaks is the burn rate in inches per second. The average of these burn rates (2 data points per strand) over the manifold of data points for all strands of a particular propellant is taken as the burn rate for that propellant. The standard deviation is computed by normal procedures, when at least 10 data points are obtained.

The burning rates so obtained are:

control: 0.145 ± 0.024 inches per second

2% bis-ammonium decahydrodecaborate: 0.235 ± 0.021 inches per second, or a burning rate increase of 61%.

EXAMPLE II

Additional blends of decahydrodecaborate compounds with the typical and representative active binder "X9" propellant are made and tested in a manner identical to Example I. Decahydrodecaborate compounds representative of each of the three forementioned classes are tested. These results are shown in Table I.

TABLE I

| Decahydrodecaborate Compound | Class | Wt. % | Burning Rate Inches per Second |
|---|---|---|---|
| None (control) | — | — | 0.145 ± .024 |
| Cesium decahydrodecaborate ($Cs_2B_{10}H_{10}$) | 1 (h) | 1 | 0.168 ± .010 |
| | | 2 | 0.185 ± .008 |
| | | 4 | 0.212 ± .007 |
| bis-ammonium decahydrodecarborate (From Example I) $(NH_4)_2B_{10}H_{10}$ | 1 (a) | 2 | 0.235 ± .021 |
| Double salt of cesium decahydrodecaborate (−2) | 2 | 1 | 0.201 ± .021 |
| | | 2 | 0.187 ± .022 |

TABLE I-continued

| Decahydrodecaborate Compound | Class | Wt. % | Burning Rate Inches per Second |
|---|---|---|---|
| and cesium nitrate | | 4 | 0.217 ± .022 |
| Coprecipitate of cesium decahydrodecaborate (−2) and potassium nitrate | 3 | 2 | 0.234 ± .053 |

The data show that the decahydrodecaborate compounds universally increase the burning rates of the propellants incorporating them over that of the control propellant. Furthermore, in the case of propellants incorporating cesium decahydrodecaborate (−2), the burning rates are stablized, which is a highly desirable feature.

The embodiments of the specific nitrocellulose base propellant compositions disclosed herein, in which an exclusive property or privilege is claimed, are to be defined, as follows.

We claim:

1. An active binder propellant composition comprising, by weight:

(A) a nitrocellulose binder in the range 8–99.9 percent;

(B) oxidizer or monopropellant in the range 0–60 percent; and (C) a burn rate catalyst, in the range 0.01–20 percent, which consists of certain decahydrodecaborate salts, having the common anion $B_{10}H_{10}^{-2}$ wherein the cation is selected from the group consisting of:

(i) ammonium, wherein the salt has the formula $(NH_4)_2B_{10}H_{10}$;

(ii) hydrazinium, wherein the salt has the general formula $(NH_2NH_3)B_{10}H_{10}$;

(iii) substituted ammonium cations, wherein the salt has the general formula $(R_3NH)_2B_{10}H_{10}$, wherein further R is selected from the group consisting of hydrogen and alkyl radicals containing less than six carbon atoms;

(iv) substituted hydrazinium cations, wherein the salt has the general formula $(R_2NNR_2H)_2B_{10}H_{10}$ wherein further R is selected from the group consisting of hydrogen and alkyl radicals containing less than six atoms, wherein said burn rate catalyst is further the resultant product of a coprecipitation of one of said group of decahydrodecaborate salts, and a solid oxidizing agent, by the process of:

(i) dissolving both the decahydrodecaborate (−2) salt and the solid oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining fluid.

2. An active binder propellant composition comprising, by weight:

(A) a nitrocellulose binder in the range 8–99.9 percent;

(B) oxidizer or monopropellant in the range 0–60 percent; and (C) a burn rate catalyst, in the range 0.01–20 percent, which consists of certain decahydrodecaborate salts, having the common anion $B_{10}H_{10}^{-2}$, and a cation selected from the group consisting of:

(i) tetramethylammonium, $(CH_3)_4N+$, tetraethylammonium, $(CH_3CH_2)_4N+$, and quaternary ammonium cations having the general formula $R_4N+$ wherein R is an alkyl radical;

(ii) pyrididinium, bipyridinium aryl-diazonium, aryl containing cations and substituted aryl containing cations, wherein said burn rate catalyst is further the resultant product of a coprecipitation of one of said group of decahydrodecaborate salts, and a solid oxidizing agent, by the process of:

(i) dissolving both the decahydrodecaborate (−2) salt and the solid oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

3. An active propellant composition comprising, by weight:

(A) a nitrocellulose binder in the range 8–99.9 percent;

(B) oxidizer or monopropellant in the range 0–60 percent; and (C) a burn rate catalyst, in the range 0.01–20 percent, which consists of a decahydrodecaborate salt, having the anion $B_{10}H_{10}^{-2}$, wherein the cation is guanidinium, and the salt has the formula $(C(NH_2)_3)_2B_{10}H_{10}$, wherein said burn rate catalyst is further the resultant product of a coprecipitation of bis guanidinium decahydrodecaborate, and a solid oxidizing agent, by the process of:

(i) dissolving both the decahydrodecaborate (−2) salt and the solid oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

4. An active binder propellant composition comprising, by weight:

(A) a nitrocellulose binder in the range 8–99.9 percent;

(B) oxidizer or monopropellant in the range 0–60 percent; and (C) a burn rate catalyst, in the range 0.01–20 percent, which consists of a metallic decahydrodecaborate salt, having the common anion $B_{10}H_{10}^{-2}$, wherein the cation is selected from the group consisting of:

(i) metal ions derived from the elements in Groups 1, 2, 8, 3b, 4b, 5b, 6b, 7b, and the elements of Groups 3a, 4a, 5a, and 6a which have atomic numbers respectively greater than 5, 14, 33 and 52, wherein said burn rate catalyst is further the resultant product of a coprecipitation of one of said group of decahydrodecaborate salts, and a solid oxidizing agent, by the process of:

(i) dissolving both the decahydrodecaborate (−2) salt and the solid oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonvolvent fluid;

(iv) drying the product to remove all remaining liquid.

5. An active binder propellant composition according to claim 1 wherein said nitrocellulose base binder is selected from the group consisting of nitrocellulose, nitrocellulose/nitroglycerine, and nitrocellulose/nitroglycerine/nitroguanidine.

6. An active binder propellant composition according to claim 2 wherein said nitrocellulose base binder is selected from the group consisting of nitrocellulose, nitrocellulose/nitroglycerine, and nitrocellulose/nitroglycerine/nitroguanidine.

7. An active binder propellant composition according to claim 3 wherein said nitrocellulose base binder is selected from the group consisting of nitrocellulose, nitrocellulose/nitroglycerine, and nitrocellulose/nitroglycerine/nitroguanidine.

8. An active binder propellant composition according to claim 4 wherein said nitrocellulose base binder is selected from the group consisting of nitrocellulose, nitrocellulose/nitroglycerine, and nitrocellulose/nitroglycerine, and nitrocellulose/nitroglycerine/nitroguanidine.

9. A nitrocellulose base propellant composition according to claim 5 wherein said oxidizing agent is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

10. A nitrocellulose base propellant composition according to claim 6 wherein said oxidizing agent is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

11. A nitrocellulose base propellant composition according to claim 7 wherein said oxidizing agent is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

12. A nitrocellulose base propellant composition according to claim 8 wherein said oxidizing agent is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

13. An active binder propellant composition according to claim 12 wherein the metallic salt selected is cesium decahydrodecaborate, said solid oxidizing agent is potassium nitrate, said solvent is water, and said nonsolvent stream is acetone.

14. An active binder propellant composition according to claim 13 wherein said propellant binder selected is of the double base type, comprising nitrocellulose/nitroglycerine.

15. An active binder propellant composition according to claim 14 wherein said double base propellant further comprises approximately, by weight, 48% nitroglycerine, 12.05% triactin, 5% cellulose acetate, 2% nitrodiphenylamine, 2% lead 2-ethyl hexoate and 0.05% candilla wax.

16. An active binder propellant composition according to claim 14 wherein said burn rate catalyst is in the range 0.01–10 percent.

17. An active binder propellant composition according to claim 15 wherein said burn rate catalyst is present in the range 0.01–10 percent.

* * * * *